US006022428A

United States Patent [19]

Cranney et al.

[11] Patent Number: 6,022,428

[45] Date of Patent: Feb. 8, 2000

[54] GASSED EMULSION EXPLOSIVE

[75] Inventors: Don H. Cranney, South Jordan; Jared R. Hansen, Kearns, both of Utah

[73] Assignee: Dyno Nobel Inc., Salt Lake City, Utah

[21] Appl. No.: 09/021,482

[22] Filed: Feb. 10, 1998

[51] Int. Cl.[7] ..... C06B 45/00; D03D 23/00

[52] U.S. Cl. ..... 149/2; 149/109.6

[58] Field of Search ..... 149/46, 61, 2, 149/109.6

[56] References Cited

U.S. PATENT DOCUMENTS

| | | | |
|---|---|---|---|
| 4,141,767 | 2/1979 | Sudweeks et al. | 149/2 |
| 4,216,040 | 8/1980 | Sudweeks et al. | 149/21 |
| 4,426,238 | 1/1984 | Wasson | 149/60 |
| 4,507,161 | 3/1985 | Sujansky et al. | 149/21 |
| 4,555,276 | 11/1985 | Winston | 149/6 |
| 4,708,753 | 11/1987 | Forsberg | 149/2 |
| 4,756,776 | 7/1988 | Halliday et al. | 149/2 |
| 4,756,777 | 7/1988 | Koppes et al. | 149/88 |
| 4,784,706 | 11/1988 | McKenzie | 149/2 |
| 4,790,890 | 12/1988 | Miller | 199/2 |
| 4,790,891 | 12/1988 | Halliday et al. | 149/2 |
| 4,818,309 | 4/1989 | Yabsley et al. | 149/2 |
| 4,820,361 | 4/1989 | McKenzie et al. | 149/2 |
| 4,931,110 | 6/1990 | McKenzie et al. | 149/2 |
| 4,960,475 | 10/1990 | Cranney et al. | 149/2 |
| 5,346,564 | 9/1994 | Vance et al. | 149/109.6 |

FOREIGN PATENT DOCUMENTS

| | | |
|---|---|---|
| 844781 | of 0000 | Norway . |
| WO99/10299 | of 0000 | WIPO . |

*Primary Examiner*—Peter M. Poon
*Assistant Examiner*—Aileen J. Baker

[57] ABSTRACT

The invention comprises an emulsion explosive composition having an organic fuel as a continuous phase; an inorganic oxidizer salt solution or melt as a discontinuous phase; an emulsifier; and gas bubbles formed from a chemical gassing agent that comprises a nitrite salt and an ion selected from the group consisting of calcium ion, strontium ion and mixtures thereof as a gassing enhancer. The invention further comprises a method for chemically gassing an emulsion explosive composition. The method involves adding to a pre-formed emulsion phase a chemical gassing agent that comprises a nitrite salt and calcium or strontium ion and mixing the gassing agent uniformly throughout the emulsion phase to produce finely dispersed, sensitizing gas bubbles.

15 Claims, 1 Drawing Sheet

Comparative Gassing Rates with and without Calcium Ion

GASSED EMULSION EXPLOSIVE

GASSED EMULSION EXPLOSIVE

The present invention relates to an improved explosive composition. More particularly, the invention relates to a water-in-oil emulsion explosive composition that is sensitized by chemically formed gas bubbles. The emulsion explosive compositions of this invention contain a water-immiscible organic fuel as a continuous phase, an inorganic oxidizer salt solution as a discontinuous phase, an emulsifier, and gas bubbles formed from a chemical gassing agent that comprises a nitrite salt and calcium or strontium ion as a gassing enhancer. The invention also relates to an improved method for gassing emulsion explosive compositions.

As used herein, the term "water-in-oil" will refer to a discontinuous phase of polar or water-miscible droplets emulsified throughout a nonpolar or water-immiscible continuous phase. Such emulsions may or may not actually contain water, and those not containing water sometimes are referred to as "melt-in-oil" emulsions.

BACKGROUND OF THE INVENTION

Emulsion explosive compositions are well-known in the art. They are fluid when formed (and can be designed to remain fluid at temperatures of use) and are used in both packaged and bulk forms. They commonly are mixed with ammonium nitrate prills or ANFO to form a "heavy ANFO" product, having higher energy and, depending on the ratios of components, better water resistance than ANFO. Such emulsions normally are reduced in density by the addition of gas or air voids in the form of hollow microspheres or gas bubbles, which increase the sensitivity of the emulsion to detonation. A uniform, stable dispersion of the microspheres or gas bubbles is important to the detonation properties of the composition. The gas bubbles normally are produced by the reaction of chemical gassing agents.

Chemically gassed emulsion explosive compositions are well-known in the art. See, for example, U.S. Pat. No. 4,960,475 and the patents referenced therein. Chemical gassing agents normally are soluble in the inorganic oxidizer salt or discontinuous phase of the emulsion and react chemically in the oxidizer salt phase under proper pH conditions to produce a fine dispersion of gas bubbles throughout the emulsion. The timing of the addition of the gassing agent is important. The gassing agent or portion thereof that decomposes or reacts chemically in the oxidizer salt solution generally cannot be added to the oxidizer salt solution prior to formation of the emulsion or gassing would occur prematurely. Similarly, if an emulsion is to be subjected to further handling procedures, such as pumping into a borehole or mixing with ammonium nitrate prills or ANFO, then the chemical gassing reaction should not occur fully until after such handling occurs in order to minimize coalescence and/or escape of the gas bubbles. Further, after final placement of the explosive into a borehole, package or other receptacle, gassing should progress to completion in a desired time frame for the specific application or subsequent activities such as cooling, packaging or borehole stemming could interfere with the desired density reduction. Thus the gassing timing and rate must be optimized for a given application. U.S. Pat. No. 4,960,475 discloses the use of a gassing surfactant to accelerate the rate of gassing even in emulsions containing stabilizing polymeric emulsifiers. As used herein, the term "chemical gassing agent" shall include all components that are added to the emulsion explosive composition to produce gas bubbles.

In addition to a faster gassing rate, there are other characteristics that are desirable in a chemically gassed emulsion explosive composition. These are: (a) increased stability of the gassed composition, (b) reduced gas bubble size and (c) increased dispersion of the gas. These characteristics are important to the performance parameters of the composition, such as stability, sensitivity and detonability, and thus can be determinative of its commercial viability.

In the present invention, the addition of an appreciable amount of calcium ion ($Ca^2$+) or strontium ion ($Sr^2$+) to a nitrite salt chemical gassing agent has been found to improve the stability of a gassed emulsion explosive composition (as used herein "stability" means the persistence of an emulsified state, i.e., no phase separation or crystallization of the internal phase); to increase its gassing rate; and to generate smaller and more finely dispersed gas bubbles, which are less susceptible to coalescence, provide good sensitization and result in a higher detonation velocity for the emulsion explosive composition. As will be shown in the examples that follow, the advantages obtained from adding calcium or strontium ion often are dramatic.

SUMMARY OF THE INVENTION

The invention comprises an emulsion explosive composition having an organic fuel as a continuous phase; an inorganic oxidizer salt solution or melt as a discontinuous phase; an emulsifier; and gas bubbles formed from a chemical gassing agent that comprises a nitrite salt and an ion selected from the group consisting of calcium ion, strontium ion and mixtures thereof as a gassing enhancer. The invention further comprises a method for chemically gassing an emulsion explosive composition. The method involves adding to a pre-formed emulsion phase a chemical gassing agent that comprises a nitrite salt and calcium or strontium ion and mixing the gassing agent uniformly throughout the emulsion phase to produce finely dispersed, sensitizing gas bubbles.

DETAILED DESCRIPTION OF THE INVENTION

Figure 1:
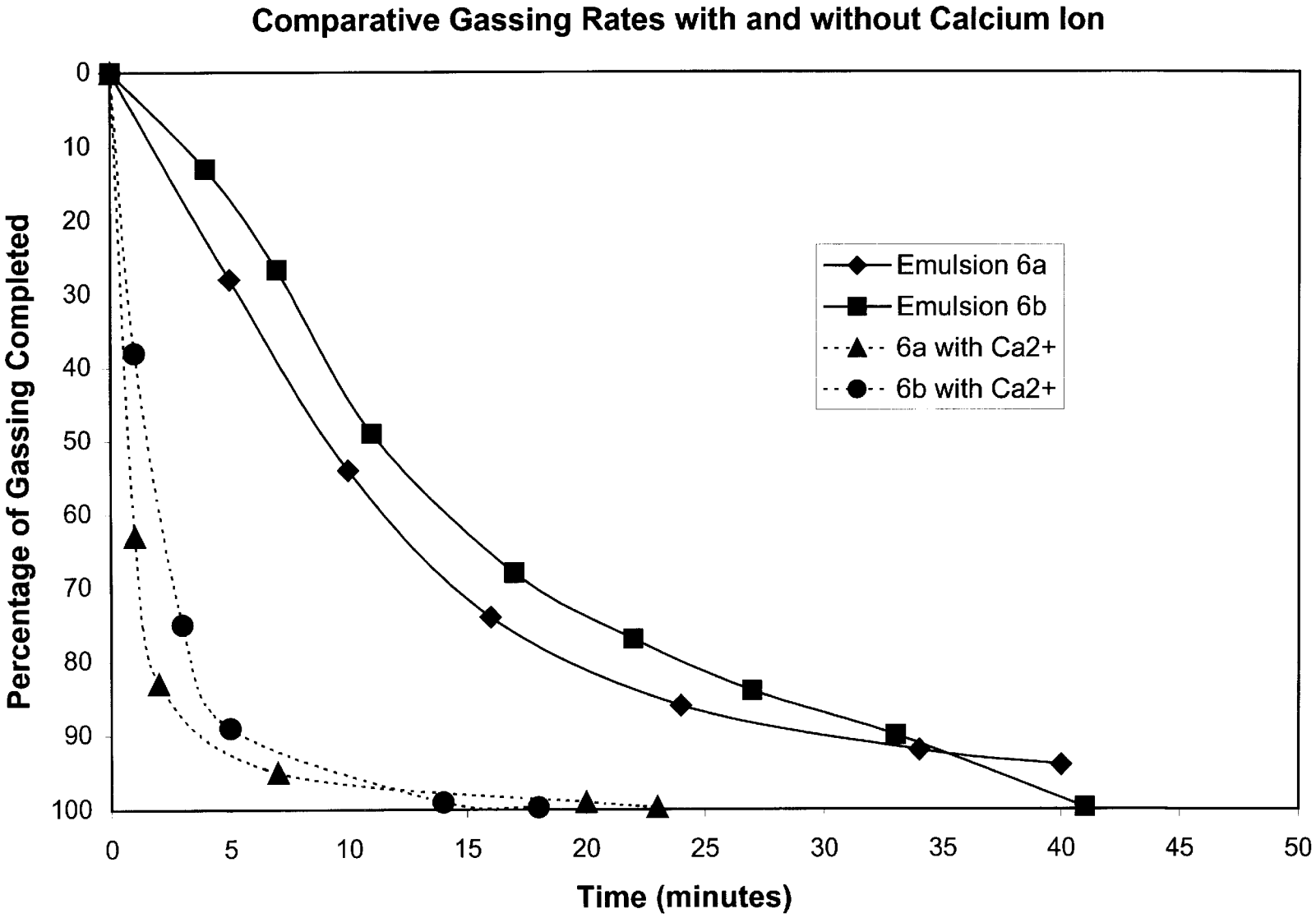

As indicated above, the chemical gassing agent or the reactive components thereof generally are added after the emulsion is formed. The timing of addition is such that gassing will occur after or about the same time as further handling of the emulsion is completed so as to minimize loss, migration and/or coalescence of gas bubbles. As the gassing agent is added and blended throughout the pre-formed emulsion phase, the nitrite ions start to react with ammonium ions or other substrates present in the oxidizer salt solution (dispersed in the emulsion as droplets) according to reactions such as the following:

$$NO_2^- + NH_4^+ \rightarrow N_2 + 2H_2O$$

Normally, the speed of the foregoing reaction between nitrite and ammonium ions depends on various solution parameters such as temperature, pH and reactant concentrations. The pH should be controlled within the range of from about 2.0 to about 5.0, depending on the desired gassing rate. The temperature may vary from an elevated formulation temperature of about 80° to 90° C. or higher down to ambient or lower temperatures of use. The reaction of course proceeds faster at higher temperatures. Other factors that have been found to determine the rate of the reaction are the stability of the emulsion, the type of emulsifier used, the presence of solid prills or microballoons, the amount of any gassing accelerator and the intensity of mixing.

Although many factors affect the stability of the emulsion, perhaps the major factor is the type of emulsifier used. Typical emulsifiers include sorbitan fatty esters, glycol esters, substituted oxazolines, alkylamines or their salts, derivatives thereof and the like. More recently, certain polymeric emulsifiers have been found to impart better stability to emulsions under certain conditions. U.S. Pat. No.

4,820,361 describes a polymeric emulsifier derivatized from trishydroxymethylaminomethane and polyisobutenyl succinic anhydride ("PIBSA"), and U.S. Pat. No. 4,784,706 discloses a phenolic derivative of polypropene or polybutene. Other patents have disclosed other derivatives of polypropene or polybutene. Preferably the polymeric emulsifier comprises polymeric amines and their salts or an amine, alkanolamine or polyol derivative of a carboxylated or anhydride derivatized olefinic or vinyl addition polymer. Most preferably, U.S. Pat. No. 4,931,110 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

The increased stability of an emulsion explosive containing a polymeric emulsifier generally means that the interface is more stable between the internal or discontinuous oxidizer salt solution phase and the continuous or external organic liquid phase. Since the chemical gassing agent is added after the emulsion is formed, and since it must find its way into the internal phase before it will react to produce gas bubbles, the more stable the interface the more difficult it is for the gassing agent to enter the internal phase.

The addition of an appreciable amount of calcium ion ($Ca^{2+}$) or strontium ion ($Sr^{2+}$) as part of a chemical gassing agent that also includes a nitrite salt improves the stability of the gassed emulsion explosive composition; increases its gassing rate; and generates smaller and more finely dispersed gas bubbles, which are less susceptible to coalescence, thereby providing good sensitization and resulting in a higher detonation velocity for the emulsion explosive composition. Moreover, these advantages are obtained even in emulsion explosive compositions having stabilizing polymeric emulsifiers of the types described above. Of the two ions, calcium ion is preferred.

The chemical gassing agent preferably comprises an aqueous solution of sodium nitrite, although other nitrite salts can be used, that reacts chemically in the oxidizer solution discontinuous phase to produce gas bubbles. To accelerate the decomposition process, preferably a gassing accelerator, such as thiocyanate salt or thiourea, is added as part of the nitrite solution or it can be included in the oxidizer solution. When sodium nitrite and thiourea are combined in the oxidizer solution phase that preferably has a pH of from about 3.5 to about 5.0, gas bubble generation commences. The nitrite salt is added in an amount of from less than 0.1% to about 0.6% by weight of the emulsion composition on a dry basis, and the thiourea or other accelerator is added in a similar amount to either the oxidizer solution discontinuous phase or the nitrite solution. The calcium or strontium ion (or mixtures thereof) preferably is added to the nitrite solution in an amount of from about 2.0% to about 10.0% by weight of the nitrite solution. The calcium or strontium ion is added as a salt and is preferably selected from the group consisting of calcium or strontium nitrite, nitrate, thiocyanate and mixtures thereof, but the calcium or strontium ion could be any similarly soluble calcium or strontium salt. Additional chemical gassing agents can be employed, and hollow spheres or particles made from glass, plastic or perlite may be added to provide further density reduction. As is known in the art, the chemical gassing agent may be pre-emulsified with an organic liquid fuel and emulsifier and added in that form.

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate (AN), but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. AN and ANFO prills also can be added in solid form as part of the oxidizer salt in the final composition.

Water generally is employed in an amount of from 3% to about 30% by weight based on the total composition. It is commonly employed in emulsions in an amount of from about 5% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels can include alcohols such as sugars and methyl alcohol, glycols such as ethylene glycols, amides such as formamide, amines, amine nitrates, urea and analogous nitrogen-containing fuels. As is well known in the art, the amount and type of water-miscible liquid(s) or solid(s) used can vary according to desired physical properties.

The emulsion of the present invention may be formulated in a conventional manner, until the time for addition of the gassing agent. Typically, the oxidizer salt(s) first is dissolved in the water (or aqueous solution of water and miscible liquid fuel) at an elevated temperature of from about 25° C. to about 90° C. or higher, depending upon the crystallization temperature of the salt solution. The aqueous oxidizer solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous oxidizer solution.) Stirring should be continued until the formulation is uniform. The chemical gassing agent that contains the calcium or strontium ion can be added to the pre-formed emulsion phase immediately after the emulsion phase is formed or up to several months thereafter when it has cooled to ambient temperature. The chemical gassing agent is added and mixed homogeneously throughout the emulsion to produce uniform gassing at the desired rate. The solid ingredients, if any, can be added along with the gassing agent and stirred throughout the formulation by conventional means. Packaging and/or further handling should quickly follow the addition of the gassing agent, depending upon the gassing rate, to prevent loss or coalescence of gas bubbles. The formulation process also can be accomplished in a continuous manner as is known in the art.

It has been found to be advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

The invention is further illustrated by reference to the following examples.

EXAMPLE 1

A water-in-oil emulsion, suitable for use in an emulsion explosive composition, was manufactured by adding a hot (70° C.) oxidizer salt solution to a hot fuel and emulsifier solution with vigorous mixing (formulation 1 in Table I). Samples of this emulsion were equilibrated at 50° C. Chemical gassing agents containing nitrite salts of sodium, potassium and calcium were prepared with equal concentrations of nitrite ion (formulations 1*a*, 1*b*, and 1*c* in Table II). These gassing agents were added to the emulsion samples at 0.5% by weight of the composition. A solution of 50% acetic acid was also added at 0.5% by weight to increase the rate of the gassing reaction. These samples were stored at 50° C. for one hour, and then at 24° C. for 3 days. The total composition of each gassed sample is reported in Table III, columns 1*a*, 1*b* and 1*c*.

Samples were inspected for deterioration of the emulsion as evidenced by phase separation and/or crystals of ammonium nitrate in the sample. Samples were given a numerical rating from 1 to 9, with 9 indicating a stable emulsion with no crystallization, and 1 indicating an emulsion showing essentially complete crystallization or phase separation. After 3 days, the emulsion sample treated with gassing agent containing sodium nitrite (sample 1*a*) had extensive crystallization and was rated a "2"; the emulsion sample treated with gassing agent containing potassium nitrite (sample 1*b*) showed moderately heavy crystallization and was rated a "5", while the emulsion sample treated with gassing agent containing calcium nitrite (sample 1*c*) was nearly crystal free and was rated an "8". Sample 1*c* also retained finer, more evenly dispersed gas bubbles. Stability ratings are included in Table III.

EXAMPLE 2

Gassed emulsion samples were prepared in a similar manner as Example 1, according to emulsion formulation 2 in Table I, and gassing agents 2*a*, 2*b*, and 2*c* in Table II. In this example, the gassing agent containing calcium ion was not prepared with calcium nitrite, but was prepared with 25% sodium nitrite, and 25% hydrated calcium nitrate ($Ca(NO_3)_2 4H_2O$), yielding a solution concentration equivalent to 17.4% calcium nitrate (solution 2*c*, Table II). Samples were gassed and stored at 35° C., and were inspected periodically for 12 days. The sample prepared with gassing agent containing calcium ion (2*c*) remained crystal free for 12 days, while the samples gassed with agent containing sodium (2*a*) or potassium nitrite (2*b*) showed heavy crystallization after 1 day. Grading over the extended period is included in Table III, columns 2*a*, 2*b*, and 2*c*

EXAMPLE 3

Gassed emulsion samples were prepared in a similar manner as the samples described in Example 1. Gassing agents 3*a*, 3*b* and 3*c* were prepared containing equimolar concentrations of sodium nitrite and the nitrate salt of a divalent cation selected from the group including calcium, magnesium, and strontium, as given in Table II. Emulsion samples were gassed at 50° C., then stored at 23° C. and inspected for crystallization. Sample 3*a*, gassed with gassing agent containing $Mg^{2+}$, was extensively crystallized and graded "2". Sample 3*b*, gassed with gassing agent containing $Sr^{2+}$, showed moderate crystallization and graded "6". Sample 3*c*, gassed with gassing agent containing $Ca^{2+}$, was nearly crystal free and graded "8". Again, the sample gassed with agent containing $Ca^{2+}$retained a finer dispersion and smaller size bubbles.

EXAMPLE 4

Gassing agents 4*a*, 4*b*, 4*c* and 4*d* were prepared from sodium nitrite, sodium thiocyanate, calcium nitrite and calcium thiocyanate according to the formulations given in Table II. Gassing agents 4*a*, 4*b*, 4*c* and 4*d* were formulated to contain 0%, 2%, 6% and 10% by weight calcium ion, with equal concentrations of nitrite ion and thiocyanate ion gassing accelerator. An emulsion was prepared according to formulation 4 given in Table I and with no thiocyanate accelerator. Samples of this emulsion were gassed at 50° C. with 0.4% acetic acid solution and 0.4% of gassing agent, using agents 4*a*, 4*b*, 4*c* and 4*d*. Emulsion sample 4*d*, gassed with gassing agent containing 10% by weight of calcium ion, was noted to have smaller bubbles than did sample 4*c*, gassed with agent containing 6% calcium ion, which was noted to have finer bubbles than sample 4*a*, gassed with agent containing 0% calcium ion. The emulsion samples were inspected for crystallization after 1 day. Emulsion samples 4*c* and 4*d*, gassed with agents containing 6% and 10% calcium ion, showed only slight crystallization and both graded "7"; sample 4*a*, gassed with agent containing 0% calcium, showed very extensive crystallization and graded "1", while sample 4*b*, gassed with agent containing 2% calcium, showed slight improvement and graded "2".

EXAMPLE 5

An emulsion was prepared which contained no thiocyanate gassing accelerator according to formulation 5 in Table I. Samples of this emulsion were equilibrated at 35° C. Gassing agent 5*a* in Table II was prepared from sodium nitrite and sodium thiocyanate. Gassing agent 5*b* was formulated to contain equal concentrations of nitrite ion and thiocyanate ion, but was prepared with calcium nitrite. Gassed emulsion samples 5*a* and 5*b* were prepared by adding 0.5% acid solution, followed by 0.5% gassing agent, immediately followed by 30% ammonium nitrate prill, with sufficient mixing between additions to disperse each ingredient thoroughly. Samples were stored at 35° C. After 1 day storage, sample 5*a* graded "5" while sample 5*b*, gassed with agent containing calcium, graded "8". After 4 days storage, sample 5*a* graded "3" while sample 5*b* graded "7".

EXAMPLE 6

Two emulsions were prepared according to formulations 6*a* and 6*b* in Table I. Samples of these emulsions were gassed at 35° C. with 0.5% acid solution and 0.5% gassing agent. Gassing agents were the same as used in samples 5*a* and 5*b*. The gassing rate of each sample was measured by measuring the density of the sample in a cup of known volume as gassing occurred. Sample density measurements are graphed in FIG. 1. The time to 90% completion of the gassing reaction ($T_{90}$) was estimated from the data shown in FIG. 1:

| Emulsion | $Na^+$ Agent | $Ca^{2+}$ Agent |
|---|---|---|
| 6a | 31.0 minutes | 6.3 minutes |
| 6b | 33.7 minutes | 6.5 minutes |

As can be seen from this data, use of a calcium containing gassing agent resulted in a substantially faster gassing rate.

EXAMPLE 7

An emulsion of the type disclosed in the previous examples was prepared having the following ratio of ingredients: 94.9% oxidizer solution, 5.0% fuel and emulsifier solution and 0.1% gassing agent comprising a 30% calcium nitrite solution. Immediately following addition of the gassing agent, cardboard tubes were filled with the emulsion. The charges in the cardboard tubes completed gassing within 15 minutes. The charges were detonated at 5° C. after one week, and the velocities of detonation were measured as follows:

| Density: | 1.18–1.20 g/cc |
|---|---|
| Charge diameters: | Velocities: |
| 125 mm | 5347 m/s |
| 100 mm | 5029 m/s |
| 75 mm | 4838 m/s |

While the present invention has been described with reference to certain illustrative examples and preferred embodiments, various modifications will be apparent to those skilled in the art and any such modifications are intended to be within the scope of the invention as set forth in the appended claims.

TABLE I

| | Emulsion Formulations | | | | | | |
|---|---|---|---|---|---|---|---|
| Example # | 1 | 2 | 3 | 4 | 5 | 6a | 6b |
| Ammonium nitrate | 76.1 | 74.1 | 76.1 | 75.7 | 77.2 | 77.2 | 77.2 |
| Water | 17.6 | 18.6 | 17.6 | 17.8 | 15.8 | 15.8 | 15.8 |
| Sodium Thiocyanate | 0.28 | 0.28 | 0.28 | | | | |
| Citric Acid | | | 0.05 | | | | |
| Polymeric Emulsifier A* | 1.2 | 2.1 | 1.2 | 1.3 | | | 0.7 |
| Polymeric Emulsifier B** | | | | | 1.4 | 1.4 | 0.7 |
| Heavy Paraffinic oil | 1.2 | 0.53 | 1.2 | | | | |
| Light Paraffinic oil | 3.6 | 4.38 | 3.6 | | | | |
| Light naphthenic oil | | | | | 2.8 | 2.8 | 2.8 |
| Heavy naphthenic oil | | | | | 2.8 | 2.8 | 2.8 |
| Used transformer oil | | | | 1.3 | | | |
| Diesel oil | | | | 3.9 | | | |
| Totals | 100 | 100 | 100 | 100 | 100 | 100 | 100 |

*Polymeric Emulsifier A: Reaction product of PIBSA and THAM (Tris-hydroxymethyl aminomethane).
**Polymeric Emulsifier B: Reaction product of PIBSA and DEEA (diethylethanolamine).

TABLE II

| Gassing Agent Formulations | | | | | | | | | | | | | | | |
|---|---|---|---|---|---|---|---|---|---|---|---|---|---|---|---|
| Example: | 1a | 1b | 1c | 2a | 2b | 2c | 3a | 3b | 3c | 4a | 4b | 4c | 4d | 5a | 5b |
| wt % Calcium ion | | | 5.8% | | | 5.3% | | | 6.1% | 0% | 2.0% | 6.0% | 10% | | 4.9% |
| Sodium nitrite | 20 | | | 25 | | 25 | 20 | 20 | 20 | 20 | 20 | 20 | 6.8 | 16 | |
| Potassium nitrite | | 25.8 | | | 41.1 | | | | | | | | | | |
| Calcium nitrite | | | 19.1 | | | | | | | | | | 12.6 | | 16.2 |
| Sodium thiocyanate | | | | | | | | | | 25 | 16.9 | 0.7 | | 32 | 32 |
| Calcium thiocyanate | | | | | | | | | | | 7.8 | 23.4 | 24.1 | | |
| Calcium nitrate | | | | | | 17.4 | | | 25 | | | | | | |
| Magnesium nitrate | | | | | | | 22.6 | | | | | | | | |
| Strontium nitrate | | | | | | | | 32.2 | | | | | | | |
| Water | 80 | 74.2 | 80.9 | 75 | 58.9 | 57.5 | 57.4 | 47.8 | 55 | 55 | 55.3 | 55.9 | 56.5 | 52 | 51.8 |

TABLE III

| Sample Composition and Stability Ratings | | | | | | | | | | | | | | | |
|---|---|---|---|---|---|---|---|---|---|---|---|---|---|---|---|
| Example: | 1a | 1b | 1c | 2a | 2b | 2c | 3a | 3b | 3c | 4a | 4b | 4c | 4d | 5a | 5b |
| Emulsion | 100 | 100 | 100 | 100 | 100 | 100 | 100 | 100 | 100 | 100 | 100 | 100 | 100 | 70 | 70 |
| Acid Solution* | 0.5 | 0.5 | 0.5 | 0.4 | 0.4 | 0.4 | 0.5 | 0.5 | 0.5 | 0.4 | 0.4 | 0.4 | 0.4 | 0.5 | 0.5 |
| Gassing solution | 0.5 | 0.5 | 0.5 | 0.5 | 0.5 | 0.5 | 0.5 | 0.5 | 0.5 | 0.4 | 0.4 | 0.4 | 0.4 | 0.5 | 0.5 |
| Low Density AN prill | | | | | | | | | | | | | | 30 | 30 |
| Gassing Temperature | 50 | 50 | 50 | 35 | 35 | 35 | 50 | 50 | 50 | 50 | 50 | 50 | 50 | 35 | 35 |
| Storage Temperature | 24 | 24 | 24 | 35 | 35 | 35 | 23 | 23 | 23 | 50 | 50 | 50 | 50 | 35 | 35 |
| Grading: | | | | | | | | | | | | | | | |
| 1 day | 2 | 5 | 8 | 2 | 5 | 9 | 2 | 6 | 8 | 1 | 2 | 7 | 7 | 5 | 8 |
| 2 days | | | | | 3 | 9 | | | | | | | | | |
| 4–5 days | | | | | | 9 | | | | | | | | 3 | 7 |
| 12 days | | | | | | 9 | | | | | | | | | |

*Acid solution was a 50% solution of acetic acid in water for all examples except #2 and #6 where acid solution was a 60% solution of acetic acid.

What is claimed is:

1. An emulsion explosive composition comprising an organic fuel as a continuous phase; an inorganic oxidizer salt solution or melt as a discontinuous phase; an emulsifier; and gas bubbles formed from a chemical gassing agent that comprises an aqueous nitrite salt solution in an amount of from less than 0.1% to about 0.6% by weight of the composition on a dry basis and an ion present in the nitrite salt solution in an amount from about 2.0% to about 10.0% by weight of the nitrite solution and selected from the group consisting of calcium ion, strontium ion and mixtures thereof as a gassing enhancer.

2. An explosive composition according to claim 1 wherein the ion is calcium ion.

3. An explosive composition according to claim 1 wherein the ion is strontium ion.

4. An explosive composition according to claim 1 wherein the emulsifier is an alkanolamine or polyol derivative of a carboxylated or anhydride derivatized olefinic or vinyl addition polymer.

5. An explosive composition according to claim 3 wherein the calcium ion is selected from the group consisting of calcium nitrite, calcium nitrate, calcium thiocyanate and mixtures thereof.

6. An explosive composition according to claim 3 wherein the strontium ion is selected from the group consisting of strontium nitrite, strontium nitrate, strontium thiocyanate and mixtures thereof.

7. An explosive composition according to claim 5 wherein the calcium ion is from calcium nitrite.

8. A method for gassing an emulsion explosive composition comprising adding to a pre-formed emulsion phase a chemical gassing agent containing a nitrite salt and an ion selected from the group consisting of calcium ion, strontium ion and mixtures thereof and mixing the gassing agent uniformly throughout the emulsion phase to produce sensitizing gas bubbles.

9. A method according to claim 8 wherein the nitrite salt is added as an aqueous nitrite solution in an amount of from less than 0.1% to about 0.6% by weight of the composition on a dry basis and the ion is present in an amount from about 2.0% to about 10.0% by weight of the nitrite solution.

10. A method according to claim 9 wherein the ion is calcium ion.

11. A method according to claim 9 wherein the ion is strontium ion.

12. A method according to claim 8 wherein the emulsifier is an alkanolamine or polyol derivative of a carboxylated or anhydride derivatized olefinic or vinyl addition polymer.

13. A method according to claim 10 wherein the calcium ion is selected from the group consisting of calcium nitrite, calcium nitrate, calcium thiocyanate and mixtures thereof.

14. A method according to claim 11 wherein the strontium ion is selected from the group consisting of strontium nitrite, strontium nitrate, strontium thiocyanate and mixtures thereof.

15. A method according to claim 14 wherein the calcium ion is from calcium nitrite.

* * * * *